US005860819A

United States Patent [19]

Northey et al.

[11] Patent Number: 5,860,819

[45] **Date of Patent: *Jan. 19, 1999**

[54] CONNECTOR ASSEMBLY

[75] Inventors: William Arthur Northey, Etters; James R. Koser, Elizabeth, both of Pa.

[73] Assignee: BERG Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[ * ] Notice: The term of this patent shall not extend beyond the expiration date of Pat. No. 5,403,196.

[21] Appl. No.: 759,031

[22] Filed: Dec. 2, 1996

Related U.S. Application Data

[60] Continuation of Ser. No. 509,106, Aug. 1, 1995, Pat. No. 5,681,173, which is a division of Ser. No. 415,189, Apr. 3, 1995, Pat. No. 5,486,115, which is a continuation of Ser. No. 149,475, Nov. 9, 1993, Pat. No. 5,403,196.

[51] Int. Cl.[6] ..... H01R 13/648

[52] U.S. Cl. ..... 439/108; 439/924.1; 439/931

[58] Field of Search ..... 439/101, 108, 439/609, 924.1, 924.2, 931

[56] References Cited

U.S. PATENT DOCUMENTS

| | | | |
|---|---|---|---|
| 4,245,876 | 1/1981 | Ritchie et al. | 439/590 |
| 4,391,482 | 7/1983 | Czeschka | 439/590 |
| 4,655,518 | 4/1987 | Johnson et al. | 439/108 |
| 4,686,607 | 8/1987 | Johnson | 439/81 |
| 4,775,333 | 10/1988 | Grider et al. | 439/736 |
| 4,869,677 | 9/1989 | Johnson et al. | 439/80 |
| 5,104,329 | 4/1992 | Brown et al. | 439/108 |
| 5,176,526 | 1/1993 | Hillbish et al. | 439/108 |
| 5,228,864 | 7/1993 | Fusselman et al. | 439/108 |
| 5,403,196 | 4/1995 | Northey et al. | 439/108 |

FOREIGN PATENT DOCUMENTS

| | | |
|---|---|---|
| 59-207476 | 11/1984 | Japan . |
| 60-236183 | 11/1985 | Japan . |
| 2 001 484 | 1/1979 | United Kingdom . |

*Primary Examiner*—Gary F. Paumen

*Attorney, Agent, or Firm*—Woodcock Washburn Kurtz Mackiewicz & Norris LLP

[57] ABSTRACT

A connector assembly 10 includes a receptacle 12 and a pin header 14 adapted to mate with the receptacle. A row of resilient enhancement contacts 18 extend through a backplane 16 and is held in place in fixed relation to the receptacle. The receptacle and pin header each comprise an insulative body portion 20, 19, respectively. The receptacle 12 comprises contact pins extending through body portion 20 and arranged in three rows of thirty-two pins per row (3×32). The pin header 14 likewise comprises contact pins extending through body portion 19 and arranged in three rows of thirty-two pins per row. The pin header 14 includes a row of contact strips 24 disposed on an outer surface of body portion 19. The contact strips are preferably of uneven lengths to provide for stage mating between the contact strips 24 and corresponding enhancements pins 18.

3 Claims, 6 Drawing Sheets

CONNECTOR ASSEMBLY

This is a continuation of application Ser. No. 08/509,106, filed Aug. 1, 1995, now U.S. Pat. No. 5,681,173, which is a division of application Ser. No. 08/415,189, filed Apr. 3, 1995, now U.S. Pat. No. 5,486,115 which is a continuation of application Ser. No. 08/149,475, filed Nov. 9, 1993, now U.S. Pat. No. 5,403,196, the disclosure of which is herein incorporated by reference.

FIELD OF THE INVENTION

The present invention relates generally to electrical connectors and more particularly to a high density or high pin count connector assembly, comprising a receptacle and pin header, with enhanced stage mating and signal carrying capability.

BACKGROUND OF THE INVENTION

With present technology for miniaturizing electronic circuitry, a high density of electronic circuits and components can be located on a printed circuit board (PCB). Accordingly, electrical connectors are needed to electrically and mechanically interconnect a first PCB, such as a back panel or mother board, to a second PCB, such as a daughter board. It is typically necessary for such connectors to have a high signal capacity. That is, the connector should pass a high number of signals per unit volume of the connector. However, closely spaced electrical signals can interfere with one another. This interference is referred to as "cross talk." Controlling such cross talk is especially important in high density connectors such as high pin count (HPC) connectors.

One method for controlling cross talk is to connect certain terminals in a high density connector to conductive areas of a printed circuit board that are in turn grounded. This solution is provided externally to the connector. In addition, there are a variety of connector arrangements for minimizing such cross talk within the connector itself.

For example, U.S. Pat. Nos. 4,655,518, 4,686,607, and 4,869,677 disclose a daughter board/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 5,228,864, Jul. 20, 1993, titled "Connectors With Ground Structure," discloses a high density electrical connector assembly with means for controlling impedance and cross talk within the connector. This patent is incorporated by reference herein and is briefly summarized below, as is another patent, namely, U.S. Pat. No. 5,104,329. The drawings of these two patents may advantageously be referred to when reading the following summaries, in which the reference numerals in parentheses refer to the elements depicted in the drawings.

The assembly disclosed in U.S. Pat. No. 5,228,864 includes a high density vertical connector or receptacle (ref. no. 500) interconnecting a circuit assembly and a mating connector. The vertical receptacle comprises an insulative housing (ref. no. 528), a plurality of "first conductive electrical contact elements" (ref. no. 535) mounted in the housing, a pair of external conductors (ref. no. 240), and an insulative spacer (ref. no. 590). The insulative housing has a first mating surface (ref. no. 548), side walls (ref. no. 530), and a plurality of passages (ref. no. 584) within the second side walls and arranged in rows and columns extending from the first mating surface through the housing. The housing also includes means for aligning the housing with the external conductors. The conductive electrical contact elements (535) are described as having any configuration (i.e., male elements, female elements or gender neutral) so long as they are useable as vertical contact elements. In addition, each of the external conductors (240) has at a plurality of "fifth contacts" (ref. no. 265) and a plurality of "sixth contacts" (ref. no. 275), wherein the fifth contacts are on one of the side walls (530) for contacting the side contacts on a side wall of a mating connector. The patent discloses that each of the external conductors can be an elongated shield member with a bent end portion for extending into corresponding retaining grooves or slots (ref. no. 552) in the mating surface of the connector.

U.S. Pat. No. 5,104,329, Apr. 14, 1992, titled "Electrical Connector Assembly," discloses an electrical connector assembly (ref. no. 10) including a receptacle member (ref. no. 12) and a pin header (ref. no. 60). The receptacle member has a housing including an inner body portion (ref. no. 22) and two opposed outer side walls (ref. no. 24), which together define elongate cavities (ref. no. 36). A plurality of "first contact terminal members" (ref. no. 40) are disposed in the inner body portion and a plurality of "second contact terminal members" (ref. no. 46) are disposed in the elongate cavities. The pin header includes a housing member (ref. no. 62) with a plurality of "third electrical contact terminal members" (ref. no. 78) and a ground bus member (ref. no. 90) disposed continuously along a side of the pin header housing. The ground bus member is adapted to be received in one of the elongate cavities of the receptacle and electrically engage the second terminal members when the receptacle member and pin header are mated.

One problem with prior art connectors of the type discussed above is that they do not provide for stage mating between corresponding contact terminals of the pin header and receptacle. For example, with reference to U.S. Pat. No. 5,104,329, the ground bus member on the pin header makes contact simultaneously with all of the second contact terminal members. There is no provision, e.g., for grounding one or more receptacle terminals prior to connecting other receptacle terminals to corresponding terminals of the pin header. Moreover, the use of a continuous ground bus of the type disclosed by U.S. Pat. No. 5,104,329 precludes the use of the surface area occupied by the ground bus for other purposes, such as the provision of additional contact terminals. Such additional contact terminals would be extremely useful in providing enhanced signal carrying capacity to the connector assembly.

SUMMARY OF THE INVENTION

A primary object of the present invention is to provide connector assemblies that provide for stage mating between corresponding contact terminals of the pin header and receptacle. Another object of the present invention is to provide connector assemblies that may take on various configurations each of which is characterized by enhanced signal carrying capacity, stage mating capability, and preferably minimal cross talk, as required by the particular application for which the connector is intended.

The present invention provides a pin header, a receptacle, and a connector assembly comprising the combination of a receptacle and a pin header adapted to mate with each other.

A pin header in accordance with the present invention comprises an insulative body comprising an outer surface, a plurality of contact pins extending through the insulative body, and a plurality of conductive contact strips disposed on the outer surface of the insulative body. A receptacle in accordance with the present invention comprises a second insulative body comprising a second outer surface, a second plurality of contact pins extending through the second insulative body, a plurality of enhancement contacts disposed externally to the second insulative body, and a board structure holding the second insulative body and enhancement contacts in a fixed position relative to each other. According to the present invention, each of the enhancement contacts is adapted to make contact with a corresponding one of the contact strips when the receptacle and pin header are mated. This feature provides enhanced signal carrying capacity to the connector with very little or no increase in connector size, as well as capabilities for grounding and EMI shielding. In preferred embodiments of the invention, means are provided for preventing stubbing of the enhancement contacts. Moreover, in preferred embodiments of the invention, at least two of the contact strips (or the enhancement contacts) are of unequal lengths. This feature provides for stage mating between corresponding pin header contact strips and receptacle enhancement contacts. That is, one contact strip-enhancement contact pair mates before another contact strip-enhancement contact pair mates.

Other features of the invention are described below.

DETAILED DESCRIPTION OF PREFERRED EMBODIMENTS

Figure 1:
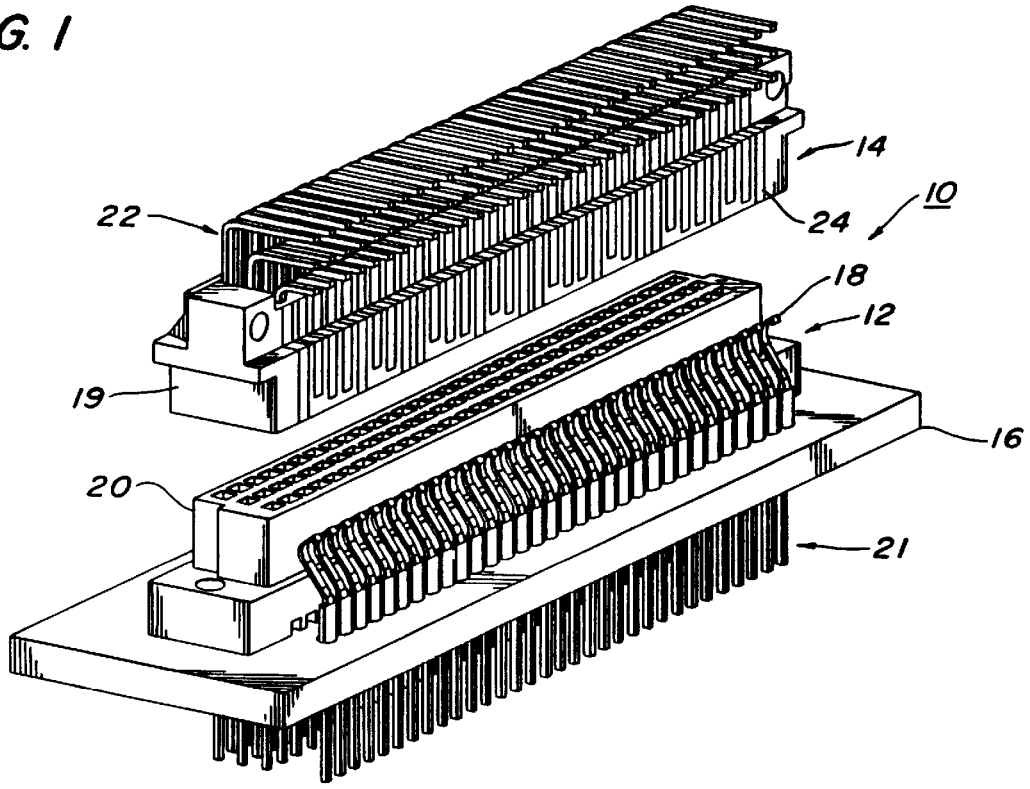
FIG. 1 depicts one exemplary embodiment of a connector assembly in accordance with the present invention, with the pin header separated from the receptacle.
Figure 1A:
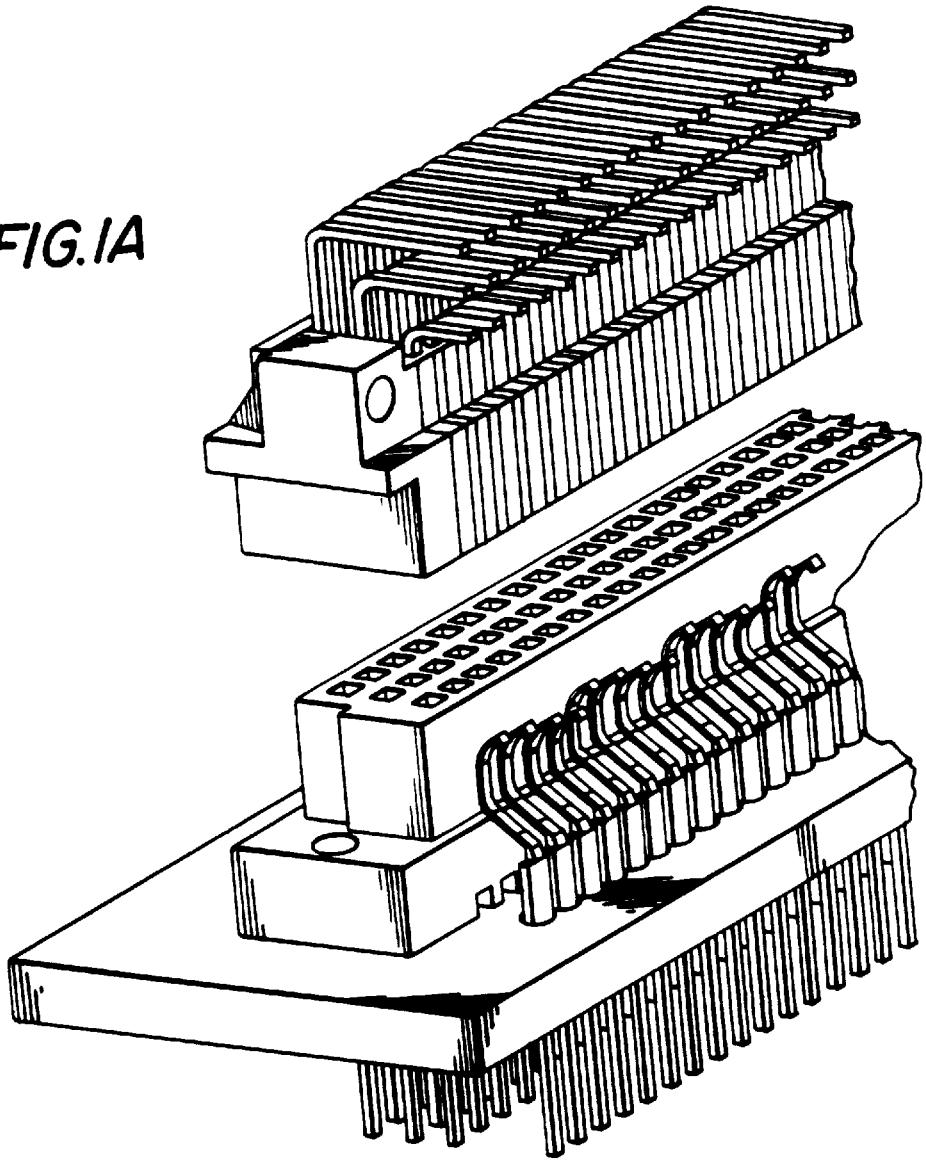
FIG. 1A depicts an embodiment like that of FIG. 1 but with the enhancement contacts of unequal lengths.

A first embodiment of a connector assembly 10 in accordance with the present invention is depicted in FIG. 1. In this drawing, a receptacle 12 is shown separated from a pin header 14 adapted to mate with the receptacle. The receptacle 12 is shown attached to a backplane member 16. In addition, a row of resilient individual enhancement contacts 18 is shown extending through the backplane 16 and held in place in fixed relation to the receptacle as by soldering or press fitting to the PCB 16. The enhancement contacts are flexible and provide a normal force perpendicular to the mating direction. The enhancement contacts are external to and separate from the receptacle 12. The receptacle and pin header each comprise an insulative body portion, or housing, denoted 20 and 19, respectively. In this particular embodiment, the receptacle 12 comprises contact pins extending through body portion 20 and arranged, for example, in three rows of thirty-two pins per row (3×32). Similarly, the pin header 14 comprises contact pins extending through body portion 19 and arranged in three rows of thirty-two pins per row. Backplane pins 21 extend from the back side of the backplane 16 in four rows of thirty-two pins per row. These correspond to the single row of thirty-two enhancement pins in combination with the 3×32 arrangement of contact pins extending through and carried by the receptacle 12. The electrical contact elements of the receptacle and pin header may be constructed to provide male elements, female elements, or gender neutral elements. Of course, male receptacle contact elements will only mate to female pin header contact elements, and vice versa. Furthermore, as shown, the pin header 14 comprises an arrangement of 3×32 right angle type contact pins 22, which are integral with or electrically connected to the 3×32 arrangement of contact pins extending through the body portion 19. In addition, the pin header includes a row of contact strips 24 disposed on an outer surface of body portion 19. Those skilled in the art will recognize that various means may be provided for making contact between these strips and conductors on a PCB (e.g., a pin may be inserted through the PCB). Preferably, the contact strips are of uneven lengths to provide for stage mating between the contact strips 24 and corresponding enhancements pins 18. Alternatively, the enhancement contacts 18 may be of uneven lengths. In either of these embodiments, at least two of the contact strips make contact with corresponding ones of the enhancement contacts at different times when the pin header is mated with the receptacle.

Figure 2:
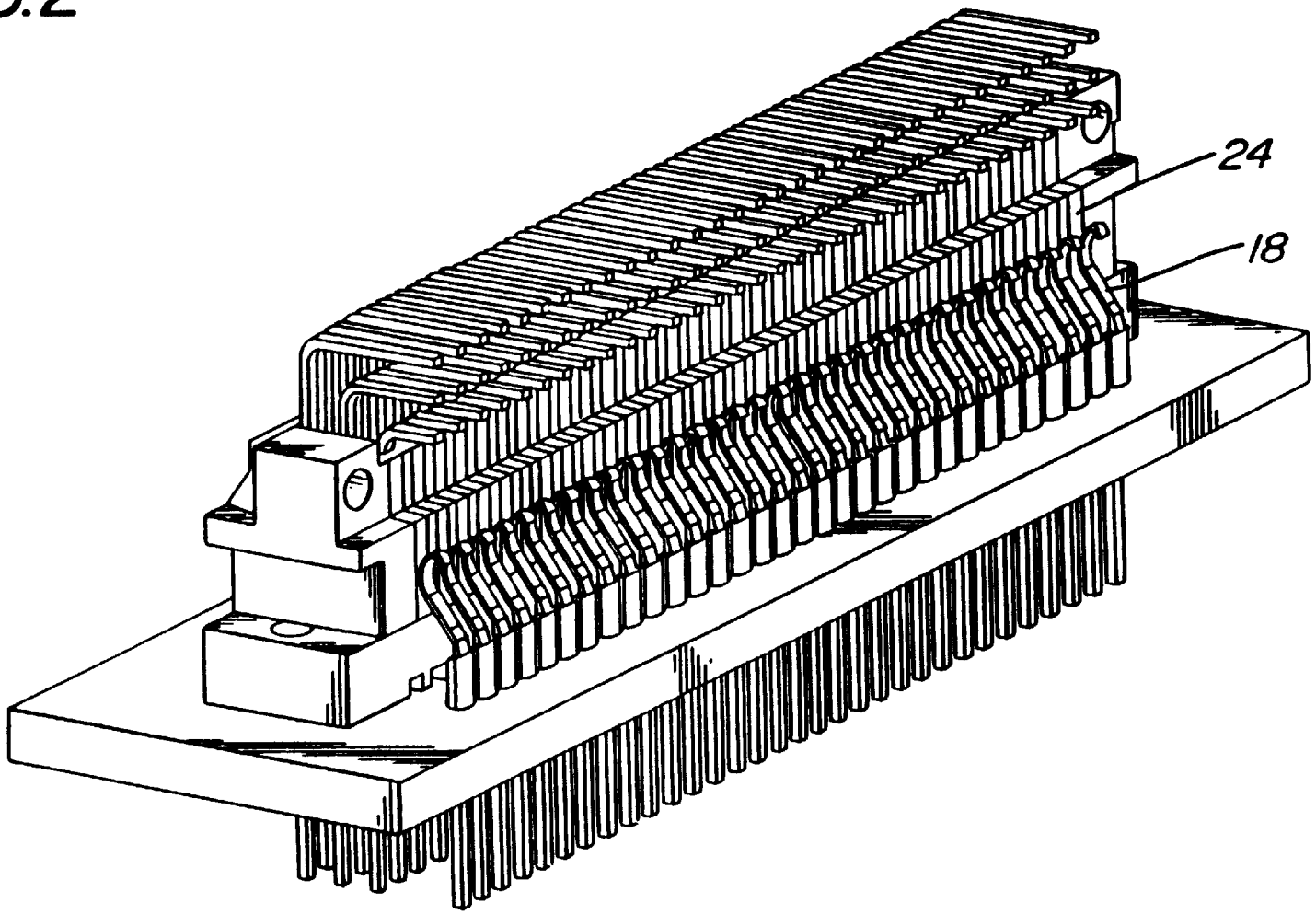
FIG. 2 depicts the assembly of FIG. 1 with the pin header mated to the receptacle.

FIG. 2 depicts the assembly of FIG. 1 with the pin header mated to the receptacle. As shown, the enhancement contacts 18 slide over and make contact with the contact strips 24 when the receptacle and pin header are mated.

Figure 3:
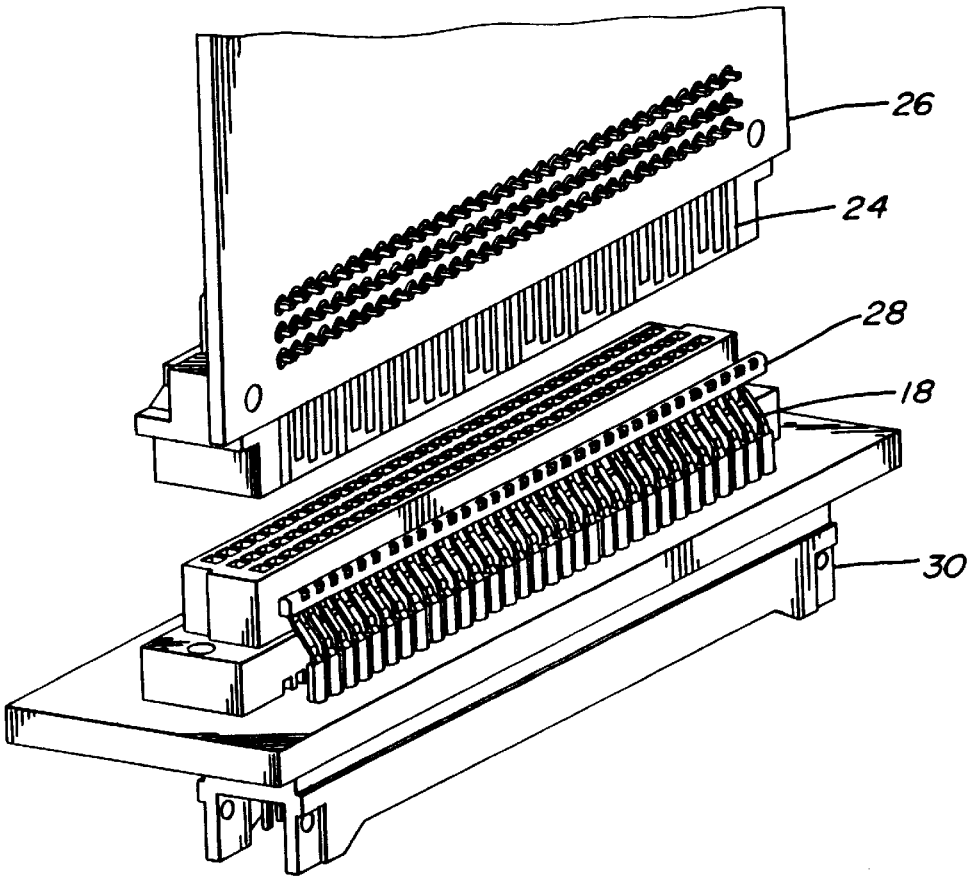
FIG. 3 depicts a second embodiment of the connector assembly, including ganged enhancement contacts.
Figure 3A:
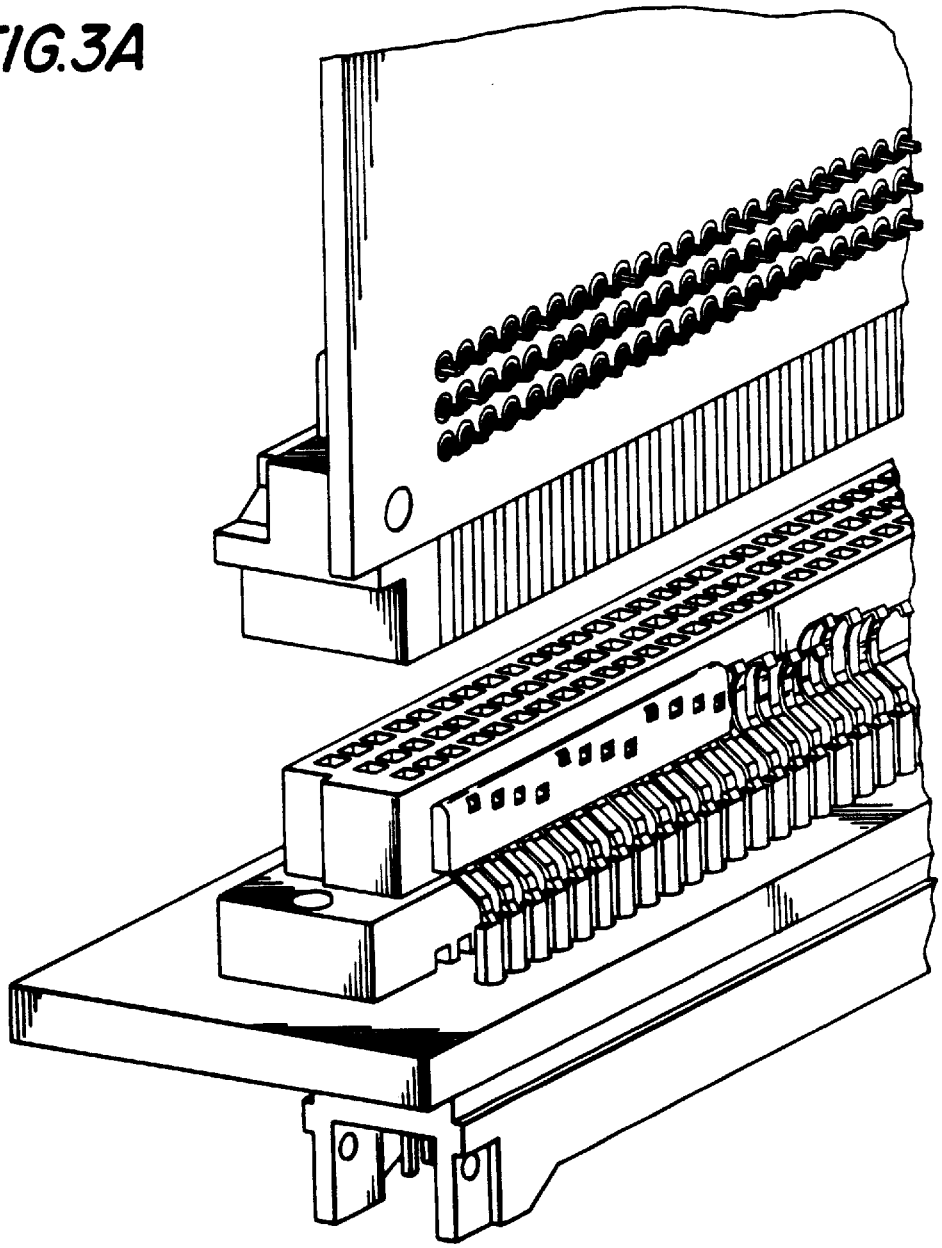
FIG. 3A depicts an embodiment like that of FIG. 3 but with the enhancement contacts of unequal lengths.

FIG. 3 shows a second embodiment of the connector assembly, including ganged enhancement contacts 18. This drawing depicts a PCB 26 through which the pins of the pin header are inserted. In addition, in this embodiment, a plastic strip 28 covering the top surface of the tips of the enhancement contacts serves to prevent inadvertent stubbing of the contacts when the receptacle is joined to the pin header. Although this feature cannot be seen in FIG. 3, it should be noted that the enhancement contacts 18 are exposed underneath the plastic strip 28, at the point where they bend, to allow electrical contact between the enhancement contacts and the contact strips 24. Finally, a backplane housing, or shroud, 30 is partially shown. FIG. 3A depicts an embodiment like that of FIG. 3 but with the enhancement contacts of unequal lengths.

An alternative embodiment of the invention (not shown) could be implemented by adhering the contact strips 24 to a surface of the shroud 30. In this embodiment, the enhancement contacts 18 would be adapted to make contact with the contact strips on the shroud. Thus, the inventive aspect of employing contact strips as disclosed above is not limited to applying said strips to a pin header.

Figure 4:
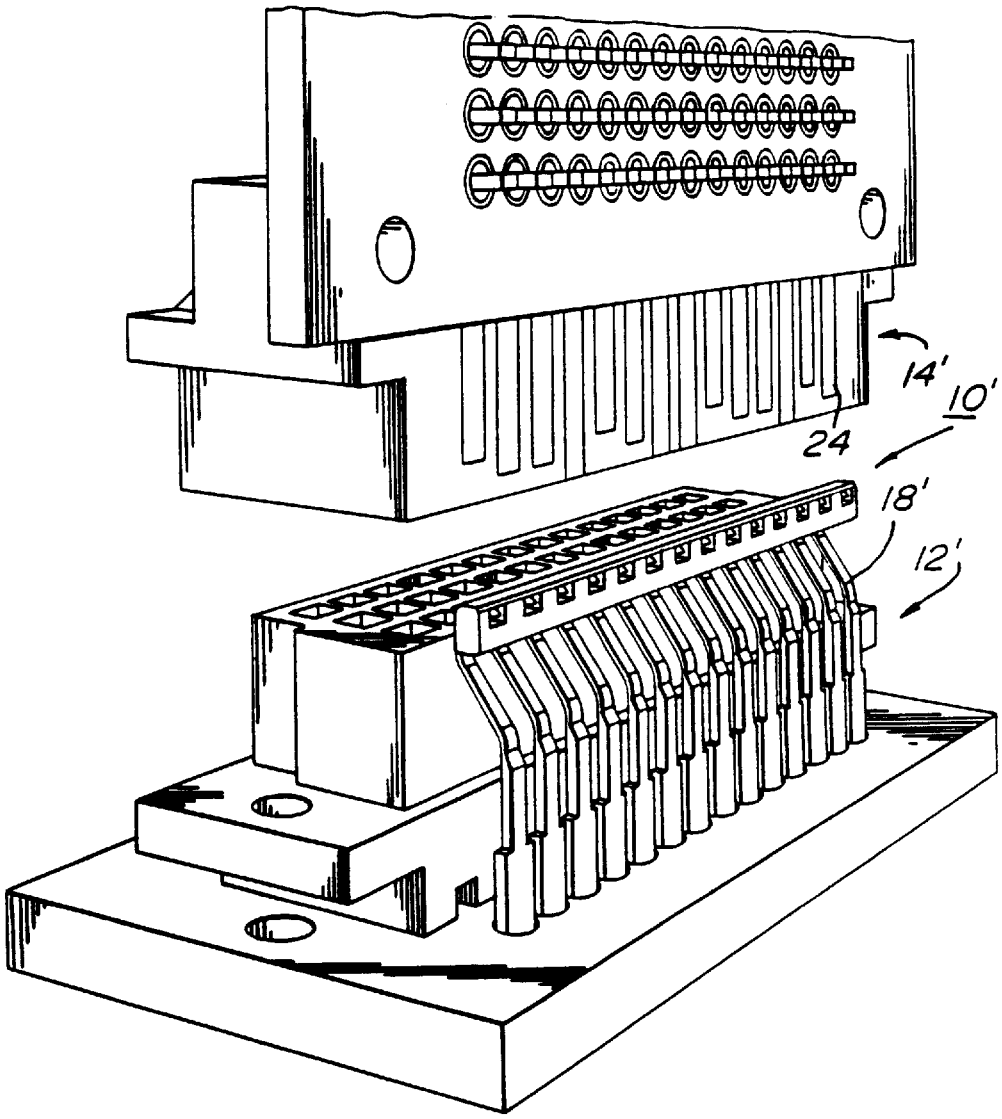
FIG. 4 depicts yet another embodiment of the connector assembly, this embodiment having a reduced contact count and elongated enhancement contacts.

FIG. 4 depicts an embodiment of the connector assembly. This embodiment comprises a receptacle 12' and pin header 14' each having contact pins extending through their respective body portions in three rows of fourteen pins per row. In addition, the receptacle includes elongated enhancement contacts 18'. The elongation of the enhancement contacts 18' allows the contacts 18' to make contact with the strips 24 before the contact pins of the receptacle and pin header mate, which may be desirable or necessary in certain applications.

The parts referred to throughout this specification can be made from known materials used to make similar conventional parts. For example, the insulative housings can be made of various plastics, such as polyetherimide resin or polyphenylene sulfide resin. The conductive walls, bases, and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

An important advantage of the present invention is that it allows for extremely cost effective modification of existing connector designs to add enhanced signal carrying capacity by adding contact strips or enhancement contacts as described herein.

Those skilled in the art, having the benefit of the teachings of this specification, may effect numerous modifications thereto. For example, the present invention is by no means limited to applications employing a right angle pin header of the type described above. Nor is the invention limited to connectors employing the specific pin counts (3×32 and 3×14) disclosed above. In addition, the enhancement contacts 18, 18' could be made of unequal lengths to achieve the stage mating capability discussed above. Accordingly, the scope of protection of the following claims is intended to encompass all embodiments incorporating the teachings of the present invention as defined in the claims.

What is claimed is:

1. A method for modifying an existing connector assembly to enhance the signal carrying capacity of the connector assembly, said method comprising:

affixing a set of contact strips to one of a section of a receptacle and a section of a pin header that form part of said connector, and affixing a set of enhancement contacts to the other of said section of the receptacle and said section of the pin header, wherein at least one of said sets of contact strips and enhancement contacts comprise at least two members of unequal length;

wherein said receptacle comprises an insulative body comprising an outer surface; a plurality of contact pins extending through said insulative body; and a board structure holding said insulative body and enhancement contacts in a fixed position relative to each other; and wherein said pin header comprises a second insulative body comprising an outer surface, wherein said contact strips are affixed to said outer surface of said second insulative body.

2. A method as recited in claim 1, further comprising the step of providing a means for preventing said enhancement contacts from stubbing.

3. A method as recited in claim 1, wherein said means for preventing stubbing of said enhancement contacts comprises a non-conductive strip attached to an end of said enhancement contacts.

* * * * *